US005702264A

United States Patent [19]

Endo et al.

[11] Patent Number: 5,702,264

[45] Date of Patent: Dec. 30, 1997

[54] CONNECTOR FOR ELECTRIC CAR

[75] Inventors: Takayoshi Endo; Kazuhisa Ishizaki; Satoshi Yamada; Takeyuki Hamaguchi, all of Shizuoka, Japan

[73] Assignee: Yazaki Corporation, Tokyo, Japan

[21] Appl. No.: 651,583

[22] Filed: May 22, 1996

[30] Foreign Application Priority Data

May 24, 1995 [JP] Japan ..... HEI. 7-125192

[51] Int. Cl.[6] ..... H01R 4/50

[52] U.S. Cl. ..... 439/346; 439/348

[58] Field of Search ..... 439/346, 347, 439/348, 352, 595

[56] References Cited

U.S. PATENT DOCUMENTS 3,964,771 6/1976 Baudouin ..... 439/348
4,047,779 9/1977 Klancnik ..... 439/348

FOREIGN PATENT DOCUMENTS 52-52090 4/1977 Japan ..... H01R 13/62

*Primary Examiner*—Khiem Nguyen
*Assistant Examiner*—Yong Ki Kim
*Attorney, Agent, or Firm*—Sughrue, Mion, Zinn, Macpeak & Seas, PLLC

[57] ABSTRACT

There is disclosed a connector for an electric car which can be of a small size, and the cost is reduced, and the efficiency of a fitting operation is enhanced. A female terminal is mounted in a tubular female housing, and a slide cover is slidably mounted on an outer periphery of the female housing. Tapered holes are formed in an electrical contact portion, and ball bearings are received respectively in the tapered holes. Projected portions for limiting outward movements of the ball bearings are formed on an inner peripheral surface of the slide cover. A groove, in which the ball bearings, projected into a bore of the electrical contact portion, are engageable, is formed in the male terminal.

5 Claims, 9 Drawing Sheets

CONNECTOR FOR ELECTRIC CAR

BACKGROUND OF THE INVENTION

1. Field of the Invention

This invention relates to a ball lock-type connector for an electric car.

2. Background

There is known a ball lock-type connector in which male and female connectors, when fitted together, are locked together against disengagement. One such connector, disclosed in Unexamined Japanese Utility Model Publication No. 52-52090, will now be described with reference to FIG. 9. FIG. 9 is a cross-sectional view showing the conventional connector. Four tapered holes 3 are formed through a peripheral wall of a female connector body 1 at a front end portion thereof, and ball bearings 5 are received respectively in the tapered holes 3 (FIG. 9 only shows one pair of the tapered holes 3 and the ball bearings 5). A spring holder 7 is slidably fitted on the outer periphery of the female connector body 1, and is normally urged forwardly by a spring 9 mounted between the spring holder 7 and the female connector body 1.

The ball bearings 5 are held in contact with an inner peripheral surface of the spring holder 7, and are held in the tapered holes 3 in the female connector body 1. When the spring holder 7 is slidingly moved rearwardly against the bias of the spring 9, a gap 11 overlaps the ball bearings 5, so that the ball bearings 5 are no longer pressed inwardly. On the other hand, during the time when the spring holder 7 is urged forwardly, the ball bearings 5 are pressed inwardly by the inner peripheral surface of the spring holder 7, and are projected inwardly from the inner peripheral surface of the female connector body 1 through the tapered holes 3.

In the connector of this construction, the spring holder 7 on the female connector body 1 is slid rearwardly by the hand against the bias of the spring 9, and the female connector body 1 is pushed onto a male connector body 13. The ball bearings 5 in contact with an outer peripheral surface of the male connector body 13 are urged outwardly into the gap 11, and the two connectors are smoothly fitted together. When the spring holder 7 is unhanded after the female connector body 1 is completely pushed, the spring holder 7 is automatically slid forwardly under the influence of the spring 9. The ball bearings 5 are pressed inwardly by the inner peripheral surface of the spring holder 7 to project into the bore of the female connector body 1, and are engaged in a groove 15 formed in the outer peripheral surface of the male connector body 13, and the two connectors are firmly connected together, with a female terminal and male terminal 19 fitted together. In the conventional connector, the male and female connectors can thus be locked together against disengagement merely by fitting the two connectors together.

In the conventional ball lock-type connector, however, the tapered holes 3 are formed in the female connector body 1 receiving the terminal, and the spring holder 7 is fitted on the female connector body 1, thereby providing the ball-lock structure. Therefore, the ball bearings 5 are interposed between the female connector body 1 and the spring holder 7, which invites a problem that the connector has an increased size.

Furthermore, in the conventional ball lock-type connector, when the female connector is to be fitted on the male connector, the spring holder 7 must be slid once to release the locking by the ball bearings 5, and in this condition the female connector must be fitted on the male connector. Thus, the two connectors cannot be fitted together by one operation, that is, by an insertion operation.

SUMMARY OF THE INVENTION

With the above problems in view, it is an object of this invention to provide a connector for an electric car which can be reduced in size, and a fitting operation can be effected merely by an insertion operation, thereby reducing the cost and also enhancing the fitting operation.

The above object of the invention has been achieved by a connector for an electric car in which a female terminal has a tubular electrical contact portion for receiving a bar-like male terminal; the female terminal is mounted in a tubular female housing; a slide cover is slidably mounted on an outer periphery of the female housing; part of the electrical contact portion is exposed within the slide cover; tapered holes are formed in the exposed portion of the electrical contact portion; ball bearings are received respectively in the tapered holes, and are projected into a bore of the electrical contact portion; projected portions are formed on an inner peripheral surface of the slide cover, and limit outward movements of the ball bearings when the projected portions overlap the tapered holes; and a groove for receiving the ball bearings projected into the bore of the electrical contact portion is formed in the male terminal.

Preferably, the slide cover is urged forwardly relative to the female terminal by a spring to cause the projected portion to overlap the tapered holes.

Preferably, a flange is formed on the male terminal, and an elastic piece portion is formed on the inner peripheral surface of the slide cover, and when the male terminal is inserted into the female terminal, the elastic piece portion engages the flange to slide the slide cover in a direction of insertion of the male terminal, and when the male terminal is inserted into a position where the tapered holes are provided, the elastic piece portion engages a distal end of the female housing to be elastically deformed, and is disengaged from the flange.

When the slider cover is slid rearwardly against the bias of the spring, the projected portions are brought out of registry with the tapered holes, so that the ball bearings can be moved. When the female connector is fitted on the male terminal, the ball bearings in contact with the male terminal are once pushed outwardly, and the two connectors are smoothly connected together. When the slide cover is unhanded after the female connector is completely pushed, the slide cover is automatically slid forwardly under the influence of the spring, so that the ball bearings are pushed inwardly by the projected portion. As a result, the ball bearings are fitted in the groove in the male terminal, and the disengagement of the two terminals from each other is prevented by the ball bearings.

In the connector in which the elastic piece portion is formed on the slide cover, when the male terminal is inserted into the female connector, the elastic piece portion of the slide cover engages the flange of the male terminal, so that the slide cover is slid rearwardly relative to the female connector. As a result, the projected portions are brought out of registry with the tapered holes, so that the ball bearings can move outwardly. When the male terminal is further inserted, the elastic piece portion is disengaged from the flange, and the slide cover is slid forwardly relative to the female connector by the spring. As a result, the ball bearings are pushed into the tapered holes by the projected portions, and at the same time is fitted in the groove in the male terminal, so that the disengagement of the two terminals from each other is prevented by the ball bearings.

DETAILED DESCRIPTION OF THE PREFERRED EMBODIMENTS

A preferred embodiment of a connector of the invention for an electric car will now be described with reference to the drawings.

Figure 1:
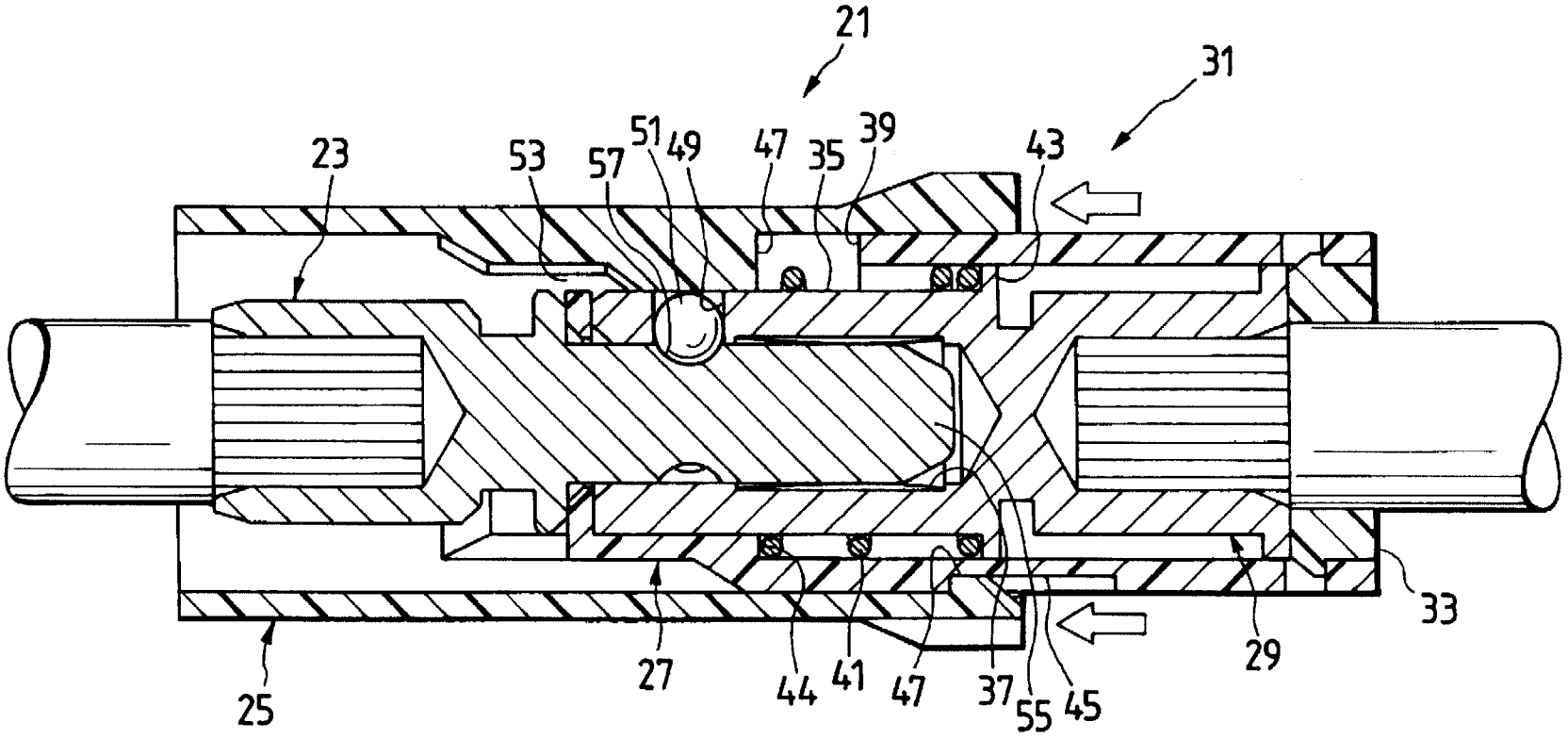
FIG. 1 is a cross-sectional view of the connector of the invention, showing a male-female fitting condition.

FIG. 1 is a cross-sectional view of the connector of the invention, showing a male-female fitting condition.

The connector 21 includes a male terminal 23 kept in an exposed condition, and a female connector 31 which includes a slide cover 25, a female housing 27 and a female terminal 29. The female terminal 29 is inserted into the tubular female housing 27 through a rear end thereof, and the female terminal 29 is retained against withdrawal by a rear holder 33 mounted on the rear end of the female housing 27.

An electrical contact portion 35 of a cylindrical shape is defined by a front end portion of the female terminal 29, and contact spring pieces 37 for contact with the male terminal 23 are provided on an inner peripheral surface of the electrical contact portion 35. A notch 39 is formed in the front end portion of the female housing 27, and part of the electrical contact portion 35 is exposed through this notch 39. A coil spring 41 is wound on the outer periphery of the electrical contact portion 35, and one end of the spring 41 is held against a flange 43 formed on a rear portion of the electrical contact portion 35, and the other end thereof is held against a stepped portion 44 formed on the inner periphery of the female housing 27. Therefore, a front portion of the spring 41 is exposed through the notch 39.

The tubular slide cover 25 is slidably mounted on the front portion of the female housing 27, and a retaining pawl 46 of the slide cover 25 is engaged in a slide groove 45 formed in the outer peripheral surface of the female housing 27, thereby preventing the slide cover 25 from being disengaged from the female housing 27. Projected portions 47 are formed on an inner peripheral surface of the slide cover 25, and are held in sliding contact with the outer peripheral surface of the electrical contact portion 35, and rear ends of the projected portions 47 are held against the other end of the spring 41.

Tapered holes 49 are formed through the peripheral wall of the electrical contact portion 35, and ball bearings 51 are received respectively in the tapered holes 49. Part of the ball bearings 51 received in the tapered holes 49 project inwardly from the inner peripheral surface of the electrical contact portion 35. When the projected portions 47 overlap the tapered holes 49, the radially outward movements of the ball bearings 51 are limited. Retraction grooves 53 are formed at the inner peripheral surface of that portion of the slide cover 25 disposed forwardly of the projected portions 47. When the retraction grooves 53 overlap the tapered holes 49, the ball bearings 51 can move into the retraction grooves 53, respectively. The ball bearings 51, when moved into the retraction grooves 53, no longer project into the bore of the electrical contact portion 35.

A groove 57 is formed in an outer peripheral surface of an electrical contact portion 55 of the male terminal 23 which can be inserted into the electrical contact portion 35. When the electrical contact portion 55 of the male terminal 23 is fully inserted into the electrical contact portion 35 of the female terminal 29, the groove 57 is disposed in registry with the tapered holes 49 in the electrical contact portion 35.

Figure 2:
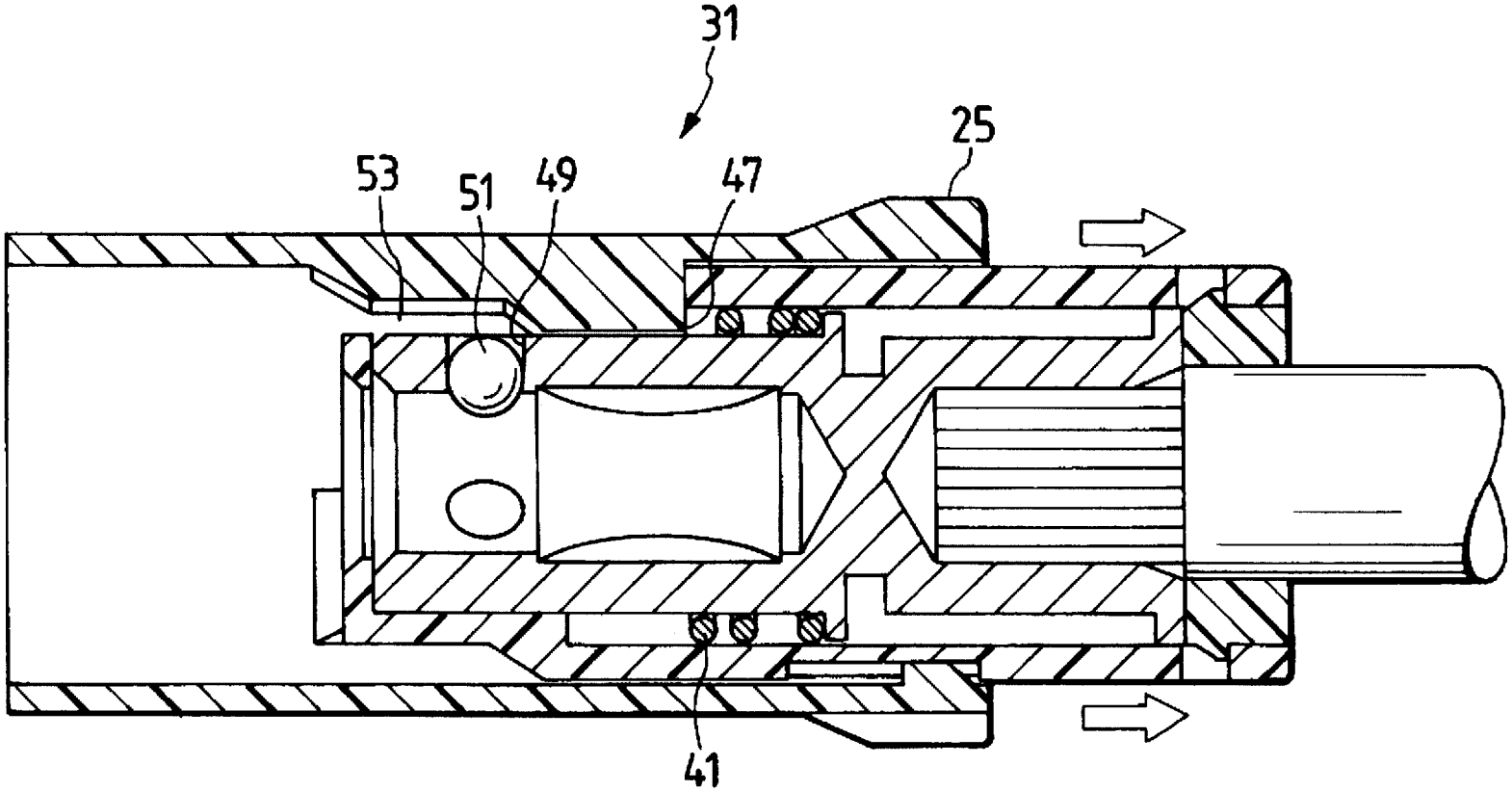
FIG. 2 is a cross-sectional view of the female connector, showing a condition in which a slide cover is slid.
Figure 3:
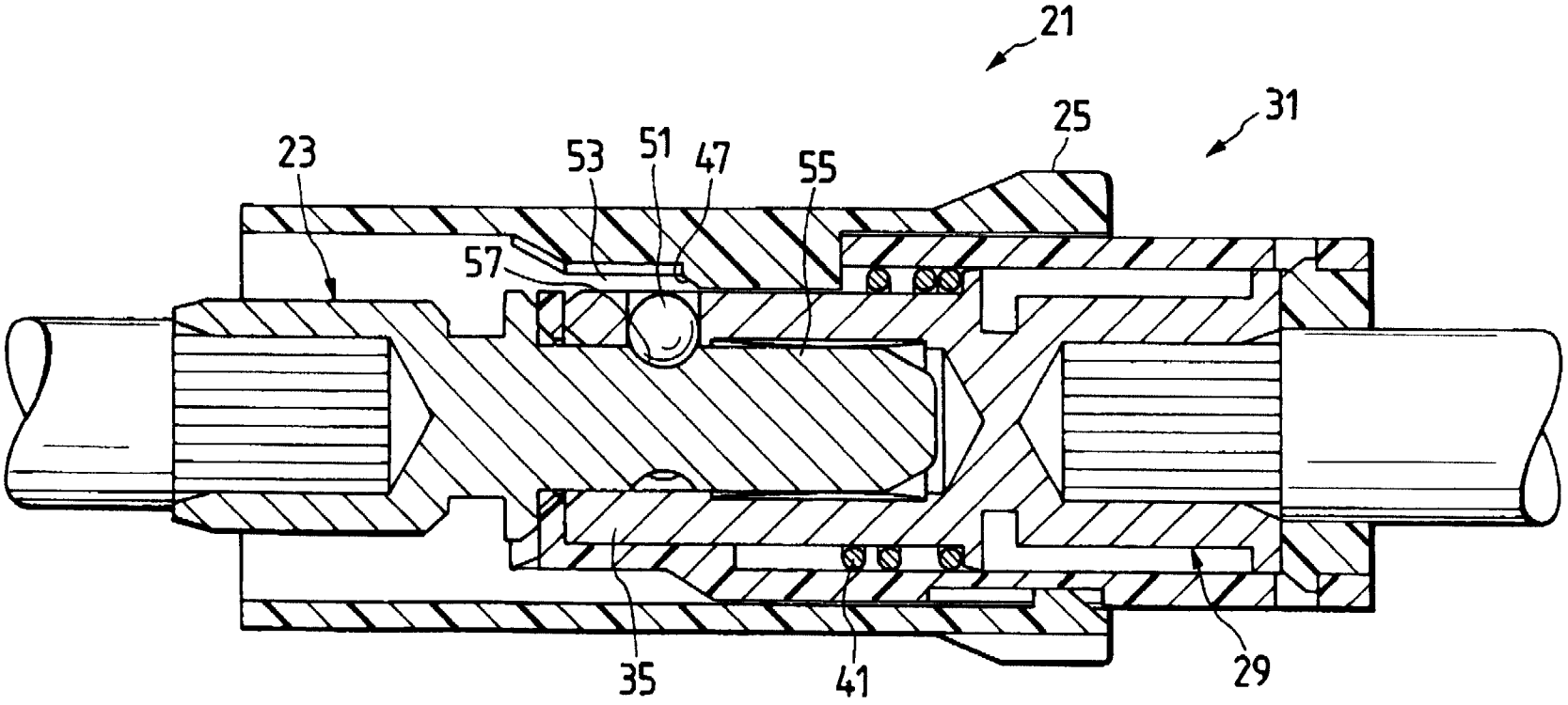
FIG. 3 is a cross-sectional view of the connector showing a condition immediately after a male terminal is inserted.

The operation of the connector 21 of this construction will now be described with reference to FIGS. 2 and 3. FIG. 2 is a cross-sectional view of the female connector, showing a condition in which the slide cover is slid, and FIG. 3 is a cross-sectional view of the connector showing a condition immediately after the male terminal is inserted.

As shown in FIG. 2, when the slide cover 25 is slid rearwardly against the bias of the spring 41 with the hand, the projected portions 47 are brought out of registry with the tapered holes 49, and the retraction grooves 53 overlap the tapered holes 49, so that the ball bearings 51 can move into the retraction grooves 53, respectively. When the female connector 31 is fitted on the male terminal 23 as shown in FIG. 3, the ball bearings 51 in contact with the outer peripheral surface of the electrical contact portion 55 of the male terminal 23 are once pushed into the retraction grooves 53, so that the two connectors are fitted together smoothly. When the slide cover 25 is unhanded after the female connector 31 is fully pushed, the slide cover 25 is automatically returned under the influence of the spring 41. The ball bearings 51 are pressed radially inwardly to be projected into the bore of the electrical contact portion 35 of the female terminal 29, and are engaged in the groove 57 in the male terminal 23 (see FIG. 1). Thus, the two connectors are firmly connected together, with the male terminal 23 inserted in the female terminal 29.

In the connector 21 of this embodiment, the tapered holes 49 are directly formed in the electrical contact portion 35 of the female terminal 29, and the ball bearings 51 are received respectively in the tapered holes 49, and the groove 57 for receiving the ball bearing 51 is formed in the outer peripheral surface of the electrical contact portion 55 of the male terminal 23. Therefore, the female terminal 29 and the male terminal 23 can be directly engaged with each other, and therefore the ball lock structure can be provided by a reduced number of parts. Therefore, the number of the component parts is reduced, and the connector can be of a small size, and the cost can be reduced.

In this connector 21, the male terminal 23 is kept in the exposed condition, and after the male terminal is connected to the female terminal, the male terminal 23 is covered by the slide cover 25 of the female connector 31, and therefore the use of a male housing can be omitted. This further reduces the cost.

In this connector 21, the female and male terminals 29 and 23 both of which are made of metal can be directly connected together through the ball bearings 51 also made of metal, and therefore the fit-retaining force of the connector can be greatly increased.

Figure 4:
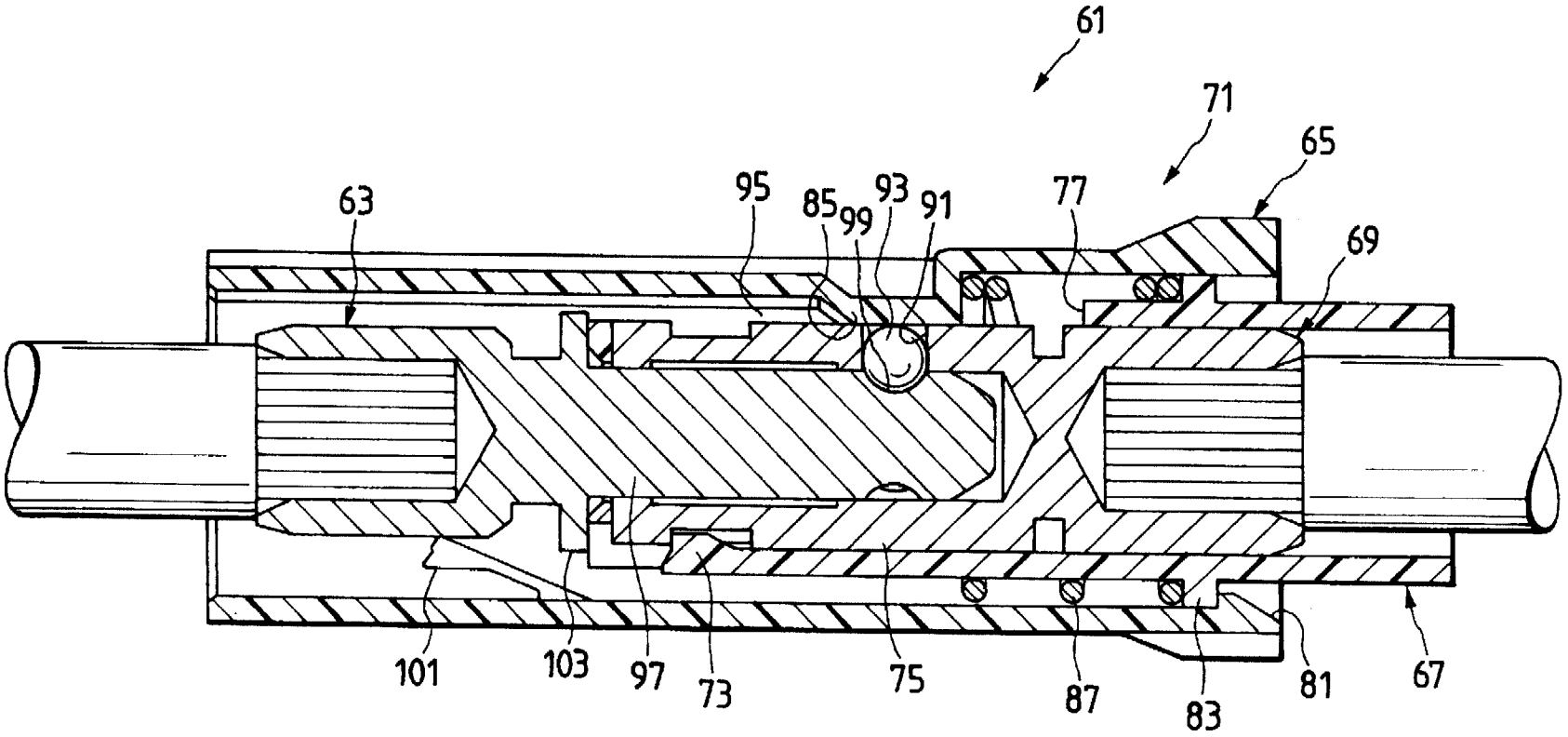
FIG. 4 is a cross-sectional view of another embodiment of connector of the invention, showing a male-female fitting condition.

Another preferred embodiment of a connector of the invention will now be described with reference to FIG. 4. FIG. 4 is a cross-sectional view of the connector of this invention, showing a male-female fitting condition.

The connector 61 includes a male terminal 63 kept in an exposed condition, and a female connector 71 which includes a slide cover 65, a female housing 67 and a female terminal 69. The female terminal 69 is inserted into the tubular female housing 67 through a rear end thereof, and the female terminal 69 is retained against withdrawal by a resilient retaining piece 73 formed on the rear end of the female housing 67.

An electrical contact portion 75 of a cylindrical shape is defined by a front end portion of the female terminal 69, and contact spring pieces (not shown) for contact with the male terminal 63 are provided on an inner peripheral surface of the electrical contact portion 75. A notch 77 is formed in the front end portion of the female housing 67, and part of the electrical contact portion 75 is exposed through this notch 77. The tubular slide cover 65 is slidably mounted on the front portion of the female housing 67, and a lance 81, formed at the rear end of the slide cover 65, is engaged with a flange 83 formed at the rear end of the female housing 67, thereby preventing the forward disengagement of the female housing 67.

Projected portions 85 are formed on an inner peripheral surface of the slide cover 65, and are held in sliding contact with the outer peripheral surface of the electrical contact portion 75. A spring 87 is mounted on the outer periphery of the front portion of the female housing 67, and one end of the spring 87 is held against the flange 83, and the other end thereof is held against the projected portions 85. Therefore, the slide cover 65 is urged forwardly by the spring 87.

Tapered holes 91 are formed through the peripheral wall of the electrical contact portion 75, and ball bearings 93 are received respectively in the tapered holes 91. Part of the ball bearings 93 received in the tapered holes 91 project inwardly from the inner peripheral surface of the electrical contact portion 75. When the projected portions 85 overlap the tapered holes 91, the radially outward movements of the ball bearings 93 are limited. Retraction groove 95 are formed at the inner peripheral surface of that portion of the slide cover 65 disposed forwardly of the projected portions 85. When the retraction grooves 95 overlaps the tapered holes 91, the ball bearings 93 can move into the retraction groove 95, respectively. The ball bearings 93, when moved into the retraction groove 95, no longer project into the bore of the electrical contact portion 75.

A groove 99 is formed in an outer peripheral surface of an electrical contact portion 97 of the male terminal 63 which can be inserted into the electrical contact portion 75. When the electrical contact portion 97 of the male terminal 63 is fully inserted into the electrical contact portion 75 of the female terminal 69, the groove 99 is disposed in registry with the tapered holes 91.

An elastic piece portion 101 of the cantilever type is formed on and projects from the inner peripheral surface of the slide cover 65, and during the time when the male terminal 63 is inserted into the electrical contact portion 75, the elastic piece portion 101 engages a flange 103 formed on the male terminal 63.

Figure 5:
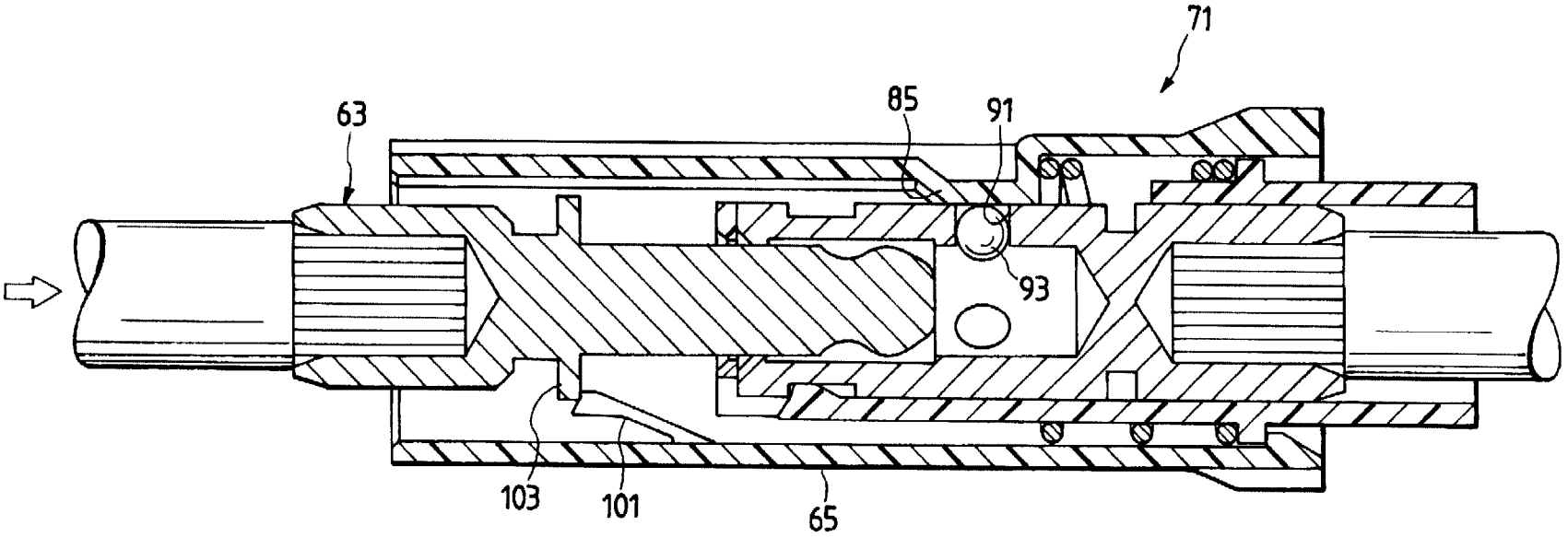
FIG. 5 is a view showing the insertion of a male terminal.

The operation of the connector 61 of this construction will now be described with reference to FIGS. 5 to 8. FIG. 5 is a view showing the insertion of the male terminal, FIG. 6 is a view showing a condition in which the slide cover is slid, and FIG. 7 is a view showing the displacement of the elastic piece portion, and FIG. 8 is a view showing a condition in which the retaining by the elastic piece portion is released.

Figure 6:
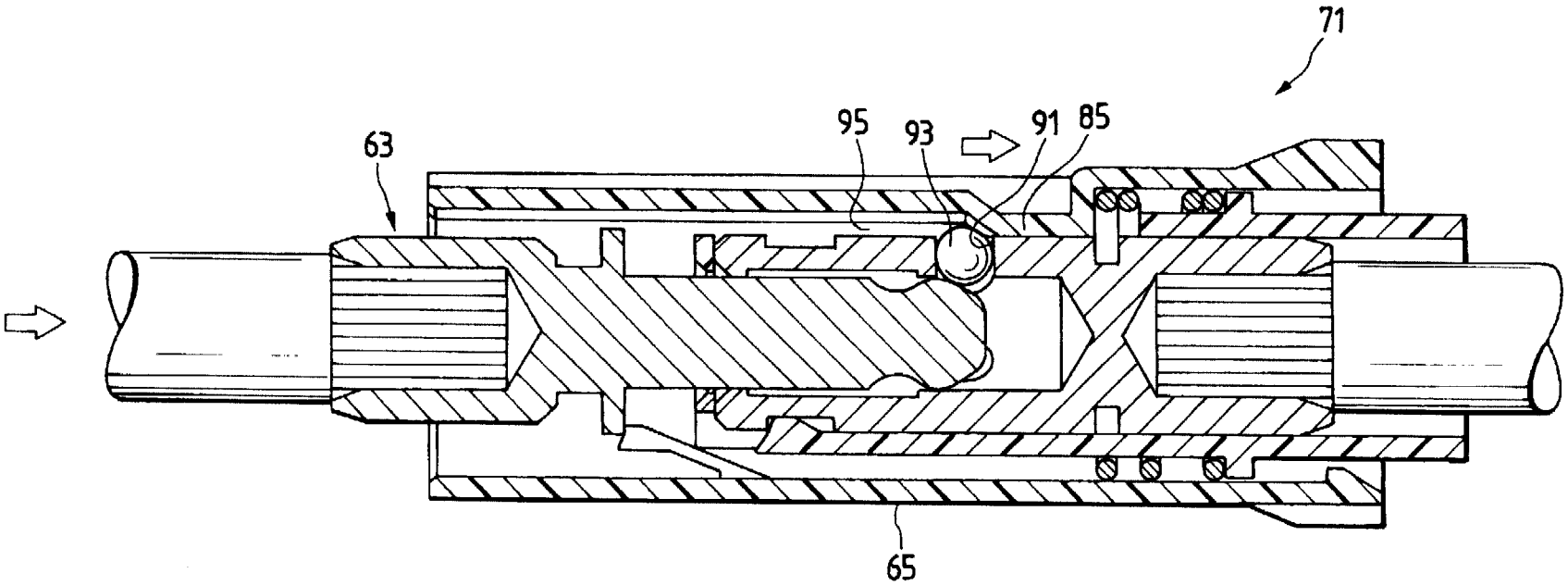
FIG. 6 is a view showing a condition in which a slide cover is slid.

When the male terminal 63 is inserted into the female connector 71, the elastic piece portion 101 of the slide cover 65 engages the flange 103 of the male terminal 63 as shown in FIG. 5, so that the slide cover 65 is slid rearwardly relative to the female connector 71, as shown in FIG. 6. As a result, the projected portions 85 of the slide cover 65 are brought out of registry with the tapered holes 91, and the ball bearings 93 are brought into registry with the retraction grooves 95, and can move radially outwardly.

Figure 7:
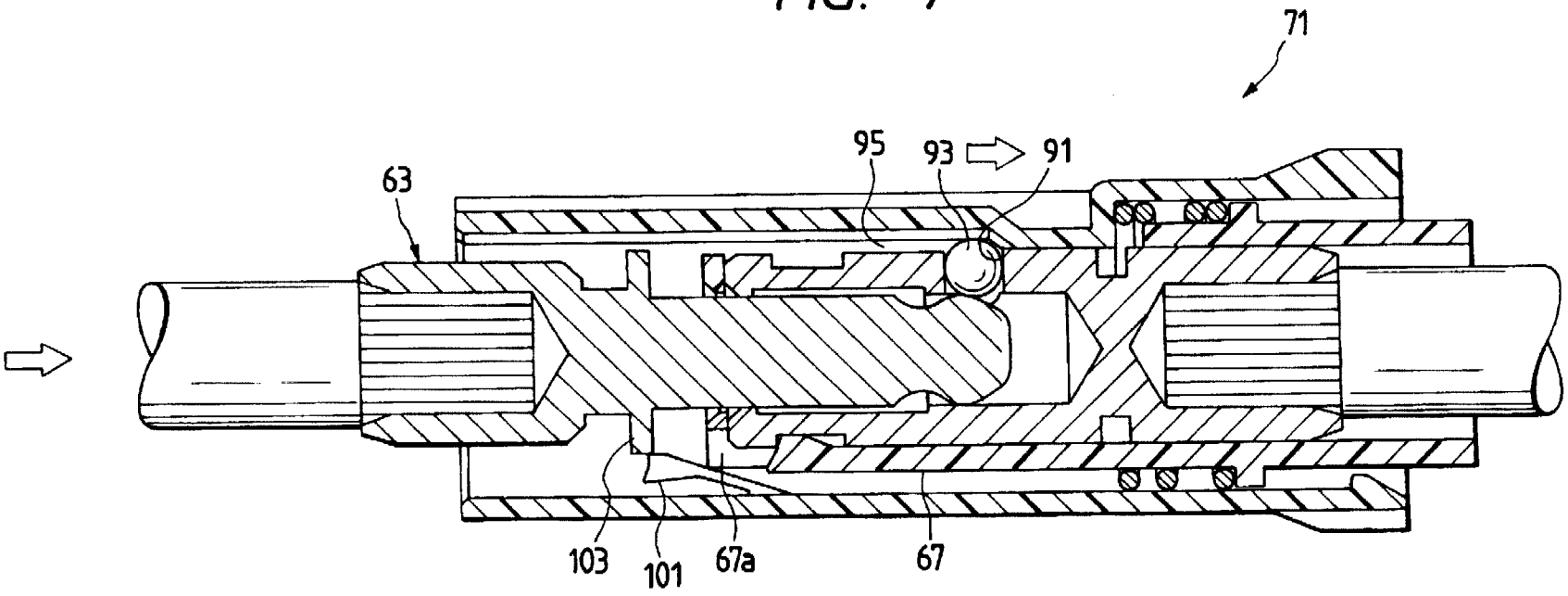
FIG. 7 is a view showing the displacement of an elastic piece portion.
Figure 8:
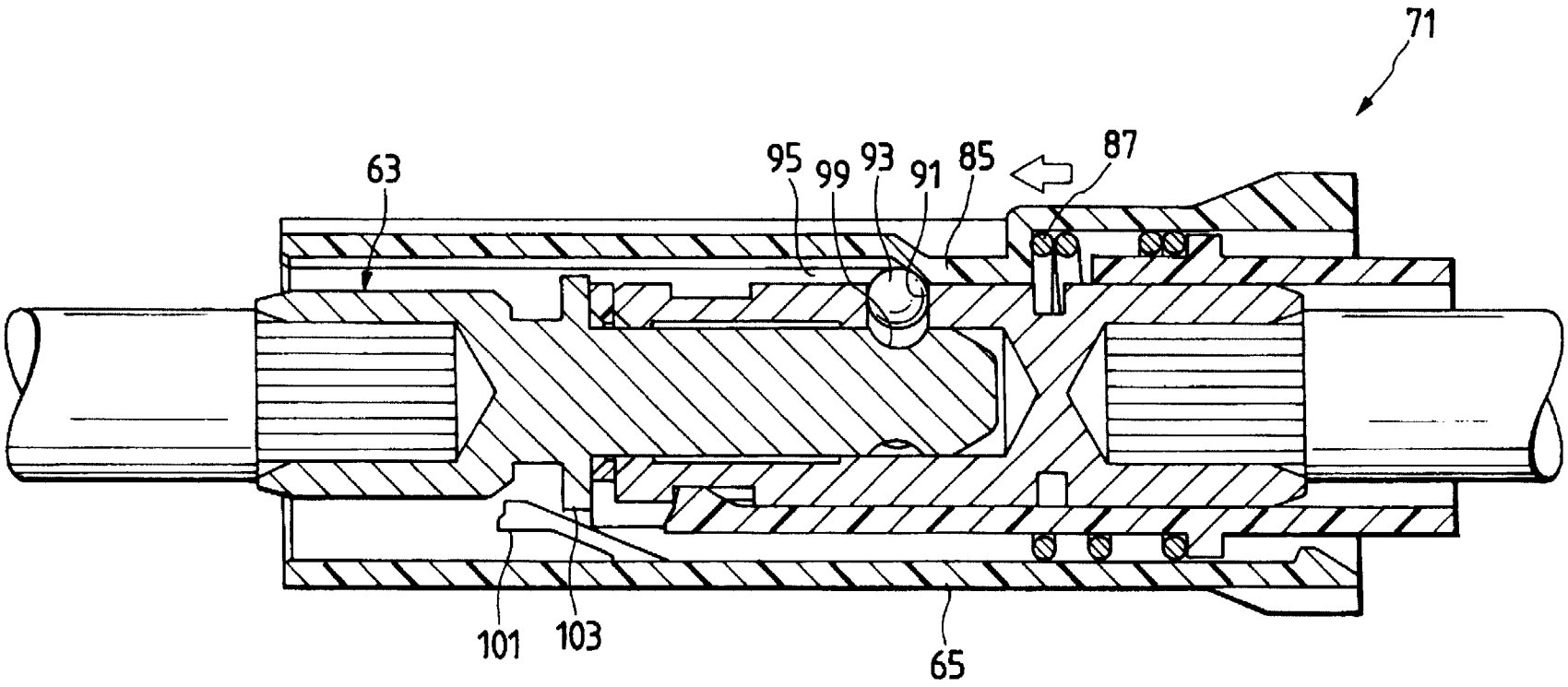
FIG. 8 is a view showing a condition in which the retaining by the elastic piece portion is released.

When the male terminal 63 is further inserted into the female connector 71 as shown in FIG. 7, the elastic piece portion 101 engages a distal end **67*a* of the female housing 67, and is elastically deformed away from the flange 103. When this elastic deformation reaches the maximum level, the elastic piece portion 101 is disengaged from the flange 103 as shown in FIG. 8, and the slide cover 65 is slid forwardly relative to the female connector 71 under the influence of the spring 87. As a result, the ball bearings 93, disposed in the retraction grooves 95, are pushed into the tapered holes 91 by the projected portions 85, and also are engaged in the groove 99 in the male terminal 63**.

When the slide cover 65 is returned to a predetermined position by the spring 87, the projected portions 85 overlaps the tapered holes 91 as shown in FIG. 4, and the ball bearings 93 are fitted in the groove 99, and are prevented from outward movement. Thus, the male terminal 63 and the female terminal 69 are firmly fitted together through the ball bearings 93.

In the connector 61 of this embodiment, as in the above-mentioned connector 21, the female terminal 69 and the male terminal 63 can be directly engaged with each other, and therefore the ball lock structure can be provided by a reduced number of parts. Therefore, the number of the component parts is reduced, and the cost can be reduced. The cost further can be reduced by omitting the use of a male housing. The female and male terminals 69 and 63 both of which are made of metal can be directly connected together through the ball bearings 93 also made of metal, and therefore the fit-retaining force of the connector can be greatly increased.

Figure 9:
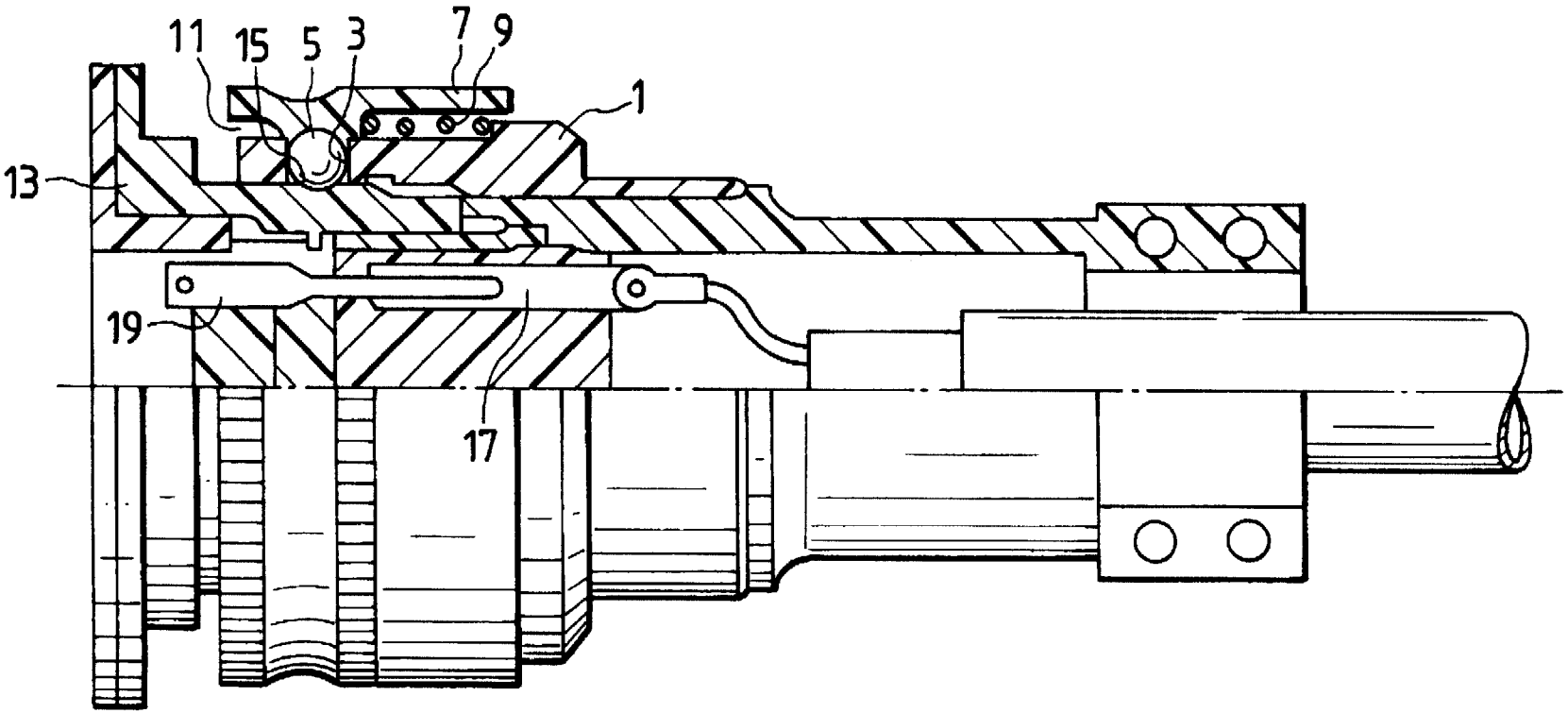
FIG. 9 is a cross-sectional view of a conventional connector.

In the connector 61 of this embodiment, the slide cover 65 has the elastic piece portion 101 which engages the male terminal 63 during the time when the connectors are fitted together, and therefore merely by inserting one connector, the slide cover 65 is automatically slid, thereby releasing the locking by the ball bearings 93, and a cumbersome operation, such as the sliding of the spring holder 7 (see FIG. 9) in the conventional construction, is omitted, and the fitting operation can be effected by a one-touch operation.

In the above second embodiment, although the male terminal 63 is adapted to be inserted into the female connector 71, the connector 61 may be of such a construction that the female connector is fitted on the male terminal 63, in which case the rear portion of the female housing 67 of the female connector 71 is held by the hand so that the movement of the slide cover 65 will not be prevented.

In the above two embodiments, the connectors can be disconnected from each other merely by pulling them away from each other while holding the slide cover 25, 65, and at this time the locking by the ball bearings 51, 93 is also released.

As described above, in the connector of the invention for the electric car, the tapered holes are formed directly in the female terminal, and the ball bearings are fitted respectively in the tapered holes, and the groove in which the ball bearings are engageable, is formed in the male terminal. Therefore, the female terminal and the male terminal can be directly engaged with each other, and the ball lock structure can be formed by a reduced number of parts. The male terminal is kept in an exposed condition, and after the connectors are fitted together, the male terminal can be covered with the slide cover of the female connector, and therefore the use of a male housing can be omitted. As a result, the cost can be reduced.

In the connector in which the elastic piece portion is formed on the slide cover, the slide cover is automatically slid merely by inserting one connector, thereby releasing the locking by the ball bearings. Therefore, a cumbersome operation, such as the sliding of the spring holder in the conventional construction, is omitted, and the fitting operation can be effected by a one-touch operation. As a result, the efficiency of the fitting operation can be enhanced.

What is claimed is:

1. A connector, comprising:

a housing;

a female terminal including an electrical contact portion for receiving an electrical contact portion of a male terminal, said female terminal mounted in said housing, said contact portion of said female terminal having an exposed portion which is exposed out of said housing;

tapered holes formed in said exposed portion;

ball bearings received respectively in said tapered holes;

a slide cover slidably mounted on an outer periphery of said housing, said slide cover having projected portions formed on an inner surface thereof so as to limit outward movements of said ball bearings from said tapered holes when said projected portions are over said tapered holes, and said slide cover having retraction grooves for receiving said ball bearings released by said projected portions when said slide cover slides; and a groove formed around said contact portion of said male terminal, said groove receiving said ball bearings projected to an inside of said contact portion of said female terminal when said male terminal is inserted into said female terminal.

2. The connector of claim 1, further comprising a spring wound on an outer periphery of said electrical contact portion, wherein said slide cover is urged forwardly relative to said female terminal by said spring so as to cause said projected portions to be over said tapered holes.

3. The connector of claim 1, further comprising a spring wound on an outer periphery of said housing, wherein said slide cover is urged forwardly relative to said female terminal by said spring so as to cause said projected portions to be over said tapered holes.

4. The connector of claim 3, further comprising a flange formed on said male terminal; and an elastic piece portion formed on the inner surface of said slide cover, wherein said elastic piece portion engages said flange so as to slide said slide cover in an insertion direction of said male terminal as said male terminal is inserted into said female terminal.

5. The connector of claim 4, said housing having a distal end which engages with said, elastic piece portion when said male terminal is inserted into said female terminal to a position where said tapered holes are provided, wherein said elastic piece portion contacts said distal end of said housing so as to be elastically deformed, said elastic piece portion being disengaged from said flange when insertion of said male terminal into said female terminal is completed.

* * * * *